US006121720A

United States Patent [19]

Rossi

[11] Patent Number: 6,121,720

[45] Date of Patent: Sep. 19, 2000

[54] APPARATUS AND METHOD OF MANUFACTURING TOP AND SIDE FIRING SPARK PLUG

[76] Inventor: Paul Rossi, 999 E. Mission Rd., Fallbrook, Calif. 92028

[21] Appl. No.: 09/286,827

[22] Filed: Apr. 6, 1999

Related U.S. Application Data

[63] Continuation of application No. 08/582,718, Jan. 4, 1996, Pat. No. 5,892,319.

[51] Int. Cl.[7] ..... H01T 13/20; H01T 13/46; H01T 13/00; P02M 57/06

[52] U.S. Cl. ..... 313/141; 313/118; 313/123; 313/139; 313/140; 313/143; 445/7

[58] Field of Search ..... 313/118, 120, 313/123, 128, 131, 139, 140, 141, 143, 131 A, 131 R; 123/169 EL, 169 CL, 169 MG; 445/7, 46

[56] References Cited

U.S. PATENT DOCUMENTS

| | | | |
|---|---|---|---|
| 1,253,584 | 1/1918 | Gerken | 313/140 |
| 1,325,439 | 12/1919 | Dinger | 313/139 |
| 1,334,135 | 3/1920 | Cuevas | 313/139 |
| 1,361,326 | 12/1920 | Hachmann | 313/118 |
| 1,439,791 | 12/1922 | Bovey | 313/118 |
| 1,465,935 | 8/1923 | Eastman | 313/118 |
| 2,453,048 | 11/1948 | Tognola et al. | 313/141 |
| 2,648,320 | 8/1953 | Phillips et al. | 313/140 |
| 3,958,144 | 5/1976 | Franks | 313/138 |
| 4,954,743 | 9/1990 | Suzuki et al. | 313/120 |
| 5,502,351 | 3/1996 | Katoh et al. | 313/141 |

*Primary Examiner*—Nimeshkumar D. Patel
*Assistant Examiner*—Mack Haynes
*Attorney, Agent, or Firm*—Steven G. Lisa

[57] ABSTRACT

A spark plug derives an extended lifetime because a large plurality of sharp edges are provided on the center electrode, the ground electrode, or both to enhance spark propagation. In a first embodiment, the ground electrode has a conventional cantilever shape, but the center electrode extends into coplanar relation to a distal surface of the electrode so that sparks propagate from the cylindrical side walls of the center electrode. In variations of the first embodiment, the number of cantilevered ground electrodes is increased, with the ground electrodes being circumferentially and equidistantly spaced about the center electrode. In another embodiment, the ground electrode has an annular configuration and includes a cylindrical annular wall spaced radially outwardly of the cylindrical sidewall of the center electrode, in concentric relation to the center electrode. Variations of the second embodiment include screw threads, knurls, and various projections formed on the ground electrode, the center electrode, or both.

19 Claims, 3 Drawing Sheets

APPARATUS AND METHOD OF MANUFACTURING TOP AND SIDE FIRING SPARK PLUG

This application is a continuation of application Ser. No. 08/582,718, filed Jan. 4, 1996 now U.S. Pat. No. 5,892,319.

BACKGROUND OF THE INVENTION

1. Field of the Invention

This invention relates to spark plugs having enhanced spark propagation and extended life. More particularly, it relates to a top and side firing plug having a center and a ground electrode with multiple edge surfaces.

2. Description of the Prior Art

The sole purpose of a spark plug is to produce a spark when needed to ignite a combustive fuel and air mixture within an internal combustion engine. A high voltage is applied to a center electrode, and a spark is created when the voltage discharges to ground by jumping across a narrow gap between the center electrode and a ground electrode.

Each discharge at least slightly fouls the spot on the ground electrode where the spark strikes it. A fouled spot has more resistance to a discharge than an unfouled spot so subsequent sparks will follow a path of least resistance to the ground electrode and thus avoid the fouled spots. Over an extended period of time, however, the entire ground electrode will become fouled and the discharges of sparks will be impeded; eventually the plug will fail and require replacement.

Spark discharge also wears down the center electrode as well; it becomes physically shorter with the passage of time. Conventional ground electrodes thus become less and less effective as the center electrode wears down because the distance the spark must jump increases as the center electrode shortens.

One way to extend the useful lifetime of a spark plug is to increase the surface area of the ground electrode. One example of a ground electrode having an increased surface area is disclosed in U.S. Pat. No. 5,280,214 to Johnson. The ground electrode takes the form of an annular ring disposed in surrounding relation to the center electrode. The surface area of the inner face of the annular ring is substantially greater than the surface area of a conventional ground electrode; accordingly, fouling of the plug takes longer and the effective lifetime of the plug is thereby extended. No means are provided, however, that take into consideration the shortening of the center electrode over time, and no means are suggested as to how the surface area of the ground electrode could be increased even further.

SUMMARY OF THE INVENTION

This invention includes several embodiments, all of them characterized by a ground electrode disposed coplanar with the free end of a center electrode so that sparks may propagate from the top and sides of the center electrode to the ground electrode. Both electrodes may be threaded or otherwise provided with surfaces that provide sharp edges that promote or facilitate spark propagation. As the center electrode decomposes, sparks continue to propagate therefrom because additional edges of the ground electrode become available to attract sparks.

In one embodiment, a plurality of circumferentially spaced apart flutes are formed in an annular ground electrode; each flute has an axis of symmetry parallel to the axis of the center electrode. The flutes provide numerous spark-attracting edges about the circumference of the ground electrode, thereby greatly increasing the number of spark-attracting edges and thereby substantially extending the effective lifetime of the plug.

In another embodiment, a square-edged groove is formed in the annular ground electrode in circumscribing relation thereto, i.e., normal to the flutes. A third embodiment eliminates the flutes and includes only the square-edged groove. Still further embodiments include beveled surfaces, knurled surfaces, sawteeth, screw threads, concentric rings, and the like formed in the ground electrode.

The purpose of the flutes, grooves, bevels, knurls, and other surfaces cut into the ground electrode is to provide a large plurality of sharp edges in the ground electrode. It has been found that such sharp edges provide a good path to ground for sparks. Since each edge will eventually become fouled, the large plurality of edges extends the lifetime of the plug.

Still another embodiment mounts the annular ground electrode within a slotted housing. The slots admit air into the housing and hence into the vicinity of the center electrode. In a preferred embodiment, the slots are partial helixes so that a swirling motion is imparted to air flowing through them. Such air flow further enhances the effectiveness of the spark generated by the plug.

The primary object of the invention is to provide a spark plug having an extended lifetime.

A more specific object is to advance the art of sparkplugs having annular ground electrodes by providing such electrodes with a large plurality of sharp edges to further enhance their effectiveness.

Still another object is to provide a means for creating a combustion-enhancing air flow in the vicinity of the spark.

Still another object is to provide a center electrode that continues operating even as it is shortened with wear.

Still another object is to provide a center electrode that continues operating even as it is shortened with wear.

These and other important objects, features, and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
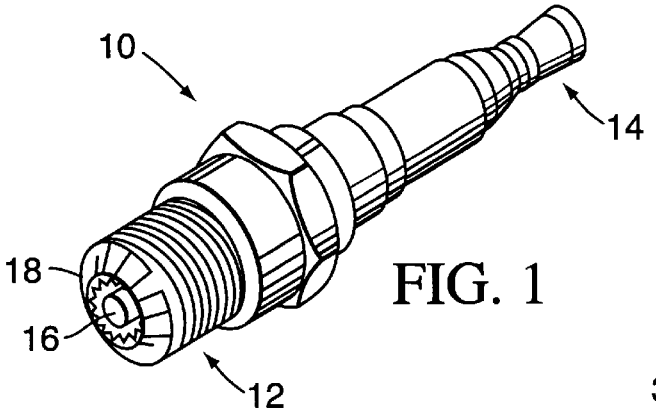
FIG. 1 is a perspective view of one of the embodiments of the invention.

Referring now to FIG. 1, it will there be seen that an exemplary embodiment of the invention is denoted as a whole by the reference numeral 10.

Figure 23:
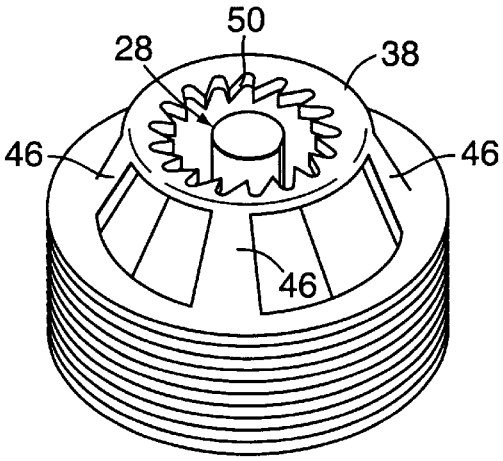
FIG. 23 is a perspective view depicting another embodiment of the invention.
Figure 24:
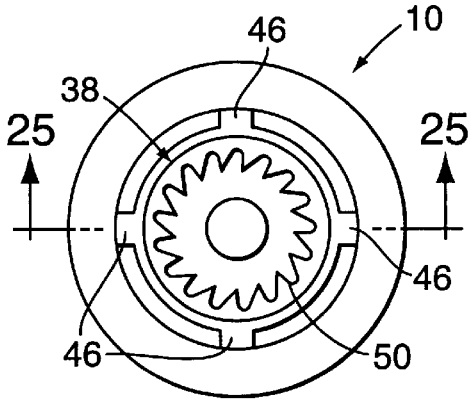
FIG. 24 is a top plan view of the embodiment depicted in FIG. 24.
Figure 25:
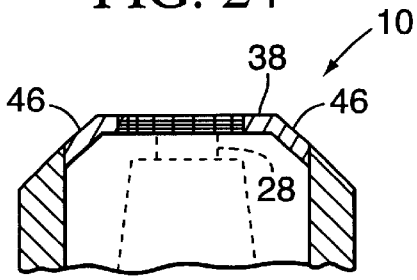
FIG. 25 is a sectional view taken along line 25—25 in FIG. 24.

The spark plug of FIG. 1 includes an electrically insulated housing having a first end 12 and a second end 14; center electrode 16 is positioned coincident with the longitudinal axis of the housing and extends a predetermined distance from said first end thereof. In the embodiment of FIG. 1, ground electrode 18 has an annular form; it will be described in connection with FIGS. 23–25 hereinafter.

Figure 2:
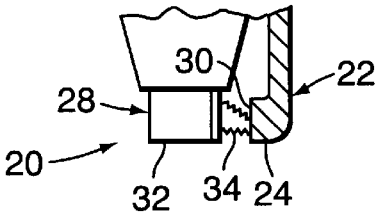
FIG. 2 is a partial side elevational view of the simplest embodiment of the invention.
Figure 6:
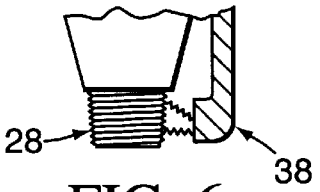
FIG. 6 is a partial side elevational view of another embodiment.

As depicted in FIG. 2. the simplest embodiment of the invention is denoted 20 as a whole; ground electrode 22 has a cantilever configuration like that of a conventional plug, but the transversely and longitudinally extending parts thereof, denoted 24 and 26, respectively, are truncated in the manner depicted. Instead of overhanging center electrode 28 as in a conventional plug, ground electrode 22 has a flat free end 30 disposed in radially spaced apart relation to a cylindrical sidewall of the center electrode 28.

Note also that the outer surface of the ground electrode is coplanar with the top surface 32 of the center electrode. Thus, a spark can propagate as indicated by the reference numeral 34. As the center electrode shortens with use, sparks can continue to propagate in a radially outward direction to the ground electrode. This is in contrast to a conventional plug where shortening of the center electrode increases the gap between the top of the center electrode and the bottom of the cantilevered ground electrode, thereby inhibiting spark propagation and eventually disabling the plug. Although only one spark 34 is indicated, sparks may propagate along any path between the cylindrical sidewalls of the center electrode 28 and flat face 30 of the ground electrode.

Figure 3:
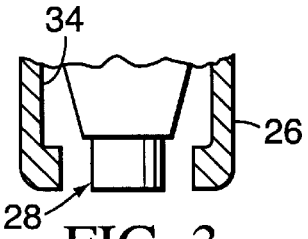
FIG. 3 is a partial side elevational view of a first variation of the simplest embodiment of the invention.
Figure 7:
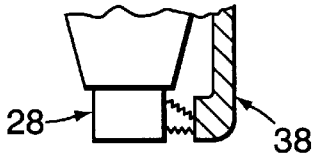
FIG. 7 is a partial side elevational view of another embodiment.

In the embodiment of FIG. 3, a second ground electrode 36 is positioned diametrically opposite to the first ground electrode 22 to double the operable surface area and hence the lifetime of the plug. Additional embodiments, not shown, add a third, fourth, etc. ground electrode, all of said ground electrodes being equidistantly and circumferentially spaced with respect to one another and being spaced radially outwardly of the ground electrode.

Figure 4:
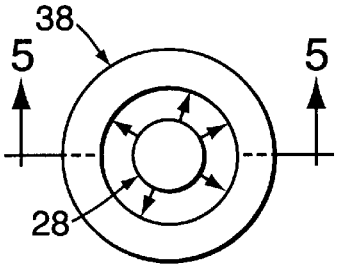
FIG. 4 is a top plan view of another embodiment of the invention.

The addition of multiple ground electrodes leads to the provision of a single annular ground electrode 38, depicted in FIG. 4, that completely surrounds center electrode 28. This provides an infinite number of radially outward paths of travel for sparks, as indicated in said FIG. 4. Although the inventive contribution of Johnson, mentioned earlier, includes an annular ground electrode, the top surface 32 of the center electrode 28 is not coplanar with the top, i.e., outer surface of the ground electrode; thus, the extended lifetime gained by extending the center electrode into coplanar relation to the ground electrode is not realized in that earlier design.

Figure 5:
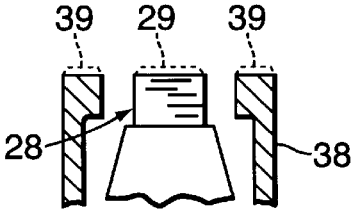
FIG. 5 is a sectional view taken along line 5—5 in FIG. 4.

The annular ground electrode 38 of this invention is depicted in sectional, side elevation in FIG. 5, and the aforementioned coplaner relation will there be seen. Firing of the plug causes decomposition of the areas indicated 29 and 39, defined by broken lines, of the center electrode 28 and the ground electrode 38, respectively. Said areas 29 and 39 are the respective distal free ends of the center and ground electrodes. Note that said distal free ends are coplanar to one another prior to electrode decomposition. As the plug fires, the spark-enhancing sharp edges become rounded or ill-defined. However, due to the coplanar relationship of the respective top surfaces of said center and ground electrodes, said top surfaces may be filed down with a suitable tool to regenerate the sharp angular edges again, as indicated by the solid lines just below the broken lines in said figure.

FIGS. 5, 6, 7, and 8 indicate that screw threads, knurls, or other edge-providing surfaces may be formed in the center electrode (FIG. 6), the ground electrode (FIG. 7), or both (FIG. 8) to provide additional spark propagation surfaces. Advantageously, standard threading or knurling tools may be used to refurbish the sharp edges of the threads and knurls as they beome worn.

Figure 9:
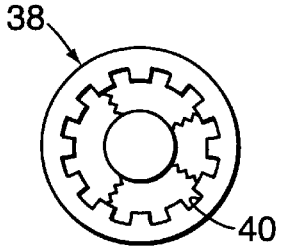
FIG. 9 is a top plan view of another embodiment.

FIG. 9 illustrates an embodiment where a plurality of equidistantly and circumferentially spaced, longitudinally extending steps or flutes 40 are formed in the annular ground electrode 38 of FIGS. 4 and 5. This adds additional sharp edges to further enhance spark propagation and to extend the life of the plug. Preferably, each of the flutes has a square "U"-shaped cross section; each of said flutes adds a pair of longitudinally disposed edges to which sparks from the center electrode may propagate. Similar steps or flutes may be formed in the ground electrodes of FIGS. 2 and 3.

FIGS. 10–13 depict annular ground electrode 38 in vertical section with differing edge-providing surfaces formed therein to enhance spark propagation.

Figure 10:
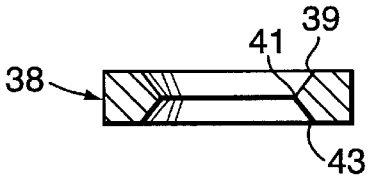
FIG. 10 is a sectional view of an annular ground electrode of one embodiment of the invention.

The inner sidewall of electrode 38 is beveled so that it protrudes radially inwardly as depicted in FIG. 10. Accordingly, before the center electrode becomes worn, sparks will travel between the top surface of the center electrode and top edge 39 of the annular ground electrode 38. As the center electrode shortens with decomposition, sparks will propagate to innermost edge 41, and as the center electrode shortens even further, sparks will propagate to lower edge 43 of the ground electrode. This is in sharp contrast with conventional plugs which fail when the center eletrode has shortened to the extent where sparks can no longer propagate to the ground electrode, i.e., this novel design provides two additional edges that become available as the center electrode decomposes, there tripling the lifetime of the plug.

Figure 11:
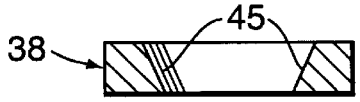
FIG. 11 is a sectional view of an annular ground electrode of another embodiment.

The bevel 45 formed in the annular electrode of FIG. 11 converges radially inwardly as depicted; thus, as the center electrode decomposes, the distance the sparks must travel is decreased. Accordingly, the effects of fouling are minimized, i.e., the distance the sparks must travel decreases over time as fouling increases with the decomposition of the center electrode.

Figure 12:
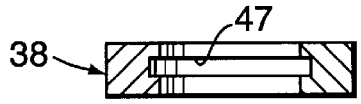
FIG. 12 is a sectional view of an annular ground electrode of another embodiment.

Instead of flutes 40 being longitudinally aligned as in the embodiment of FIG. 9, there could be a single, transversely disposed annular flute 47 formed in said annular ground electrode as depicted in FIG. 12. A square "U"-shaped flute is preferred to provide the extra edges as desired to enhance spark propagation.

Figure 13:
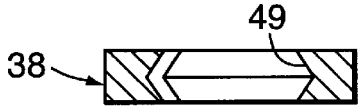
FIG. 13 is a sectional view of an annular ground electrode of another embodiment.

FIG. 13 depicts a bevel 49 that is the reverse of the FIG. 10 bevel, i.e., the bevel of FIG. 13 forms an annular recess in the inner face of ground electrode 38.

Figure 8:
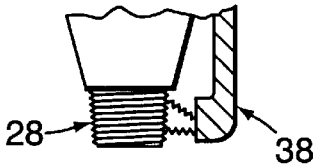
FIG. 8 is a partial side elevational view of another embodiment.
Figure 14:
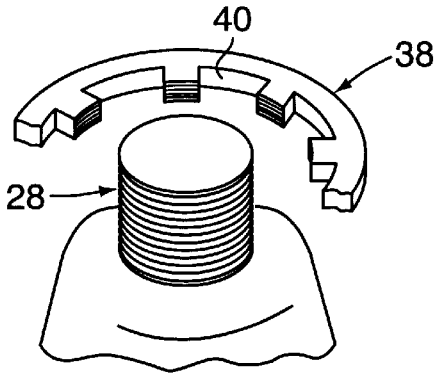
FIG. 14 is a partial, broken away perspective view of another embodiment.
Figure 15:
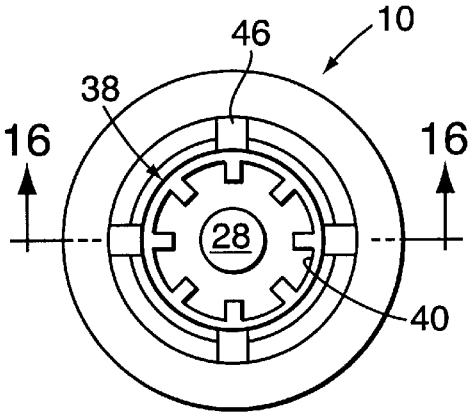
FIG. 15 is a top plan view of the embodiment depicted in FIG. 14.
Figure 16:
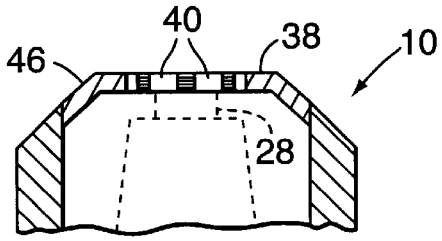
FIG. 16 is a sectional view taken along line 16—16 in FIG. 15.

The embodiment of FIGS. 14–16 is somewhat a combination of the embodiments of FIGS. 8 and 9. The flutes 40 of FIGS. 14–16 have a greater circumferential extent than the flutes of FIGS. 8 and 9, but in all other respects the embodiments are the same. As indicated earlier in connection with FIGS. 6–8, the threads could be formed on the center electrode 28 only, the annular ground electrode 38 only, or both. Note equidistantly and circumferentially spaced standoffs 46 which support annular ground electrode 38 in spaced relation to the spark plug housing. Standoffs 46 minimize heat transfer from the plug threads to the ground electrode.

Figure 17:
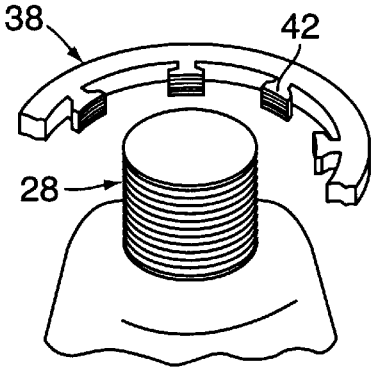
FIG. 17 is a partial, broken away perspective view of another embodiment.
Figure 18:
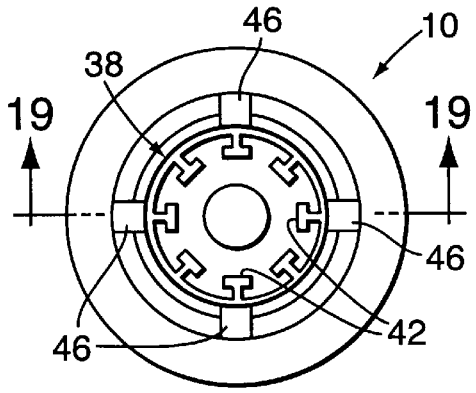
FIG. 18 is a top plan view of the embodiment depicted in FIG. 17.
Figure 19:
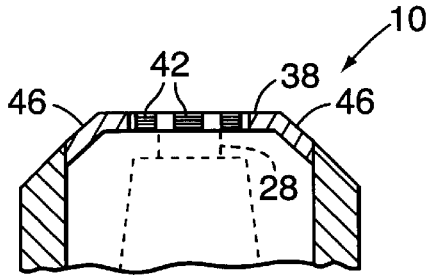
FIG. 19 is a sectional view taken along line 19—19 in FIG. 18.

The embodiment of FIGS. 17–19 provides a plurality of equidistantly and circumferentially spaced "T"-shaped projections 42 which are formed by undercutting the flutes as indicated.

Figure 20:
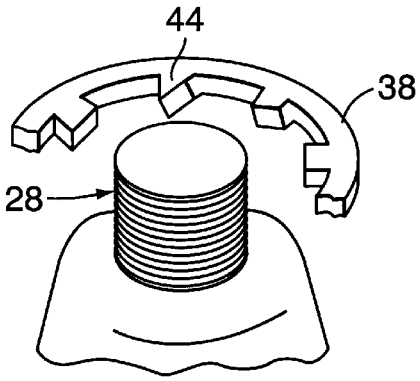
FIG. 20 is a partial, broken away perspective view of another embodiment.
Figure 21:
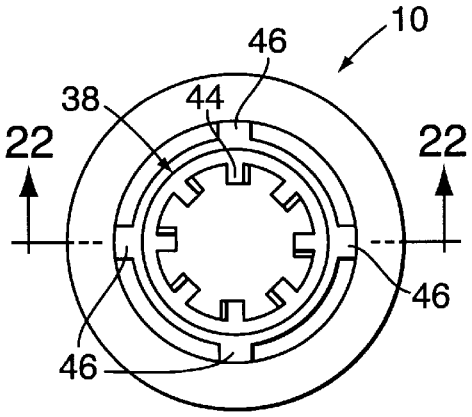
FIG. 21 is a top plan view of the embodiment depicted in FIG. 20.
Figure 22:
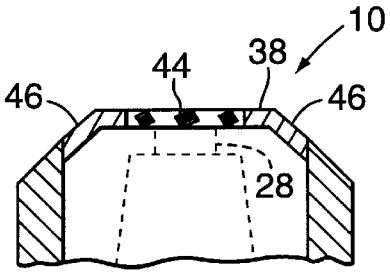
FIG. 22 is a sectional view taken along line 22—22 in FIG. 21.

Projections 44 are bent in the manner depicted in FIGS. 20–22 to enhance air turbulence in the space between the center and ground electrodes.

In the final illustrated embodiment, depicted in FIGS. 1 and 23–25, the inner face of annular ground electrode 38 has the general appearance of a saw blade, i.e., flutes 50 are curvilinear and not square "U"-shaped. Note the large number of edges provided by this design. In view of this disclosure, it is now obvious that numerous other geometrical designs could be employed to increase the number of edges to promote spark propagation even further.

It will thus be seen that the objects set forth above, and those made apparent from the foregoing description, are efficiently attained. Since certain changes may be made in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A spark plug comprising:

(a) a spark plug housing having a first end and a second end;

(b) a center electrode, having a major axis, housed within the spark plug housing, the center electrode having cylindrical sidewalls;

(c) a ground electrode mounted to the first end of the spark plug housing, the ground electrode disposed proximate the cylindrical sidewall of the center electrode;

(d) a plurality of threads formed on at least one of the electrodes, the threads providing sharp edges for sparks to propagate between the center electrode and the ground electrode.

2. The invention in accordance with claim 1 wherein the threads are formed from a continuous thread extending for at least a portion of the length of the center electrode.

3. The invention in accordance with claim 1 wherein the threads are formed of multiple separate threads.

4. The invention in accordance with claim 3 wherein the threads define the perimeter of planes and the planes are perpendicular to the major axis of the center electrode.

5. The invention in accordance with claim 3 wherein the threads define the perimeter of planes and the planes are non-perpendicular to the major axis of the center electrode.

6. The invention in accordance with claim 1 wherein the threads are formed on the ground electrode.

7. The invention in accordance with claim 6 wherein the threads on the ground electrode are perpendicular to the major axis of the center electrode.

8. The invention in accordance with claim 6 wherein the threads on the ground electrode are non-perpendicular to the major axis of the center electrode.

9. The invention in accordance with claim 1 wherein the threads formed on the center electrode define the perimeter of planes and the planes are perpendicular to the major axis of the center electrode and threads are formed on the ground electrode disposed proximate the cylindrical sidewall of the center electrode.

10. The invention in accordance with claim 9 wherein the threads formed on the ground electrode define the outer perimeter of a plane being interrupted by spaces and the threads of said ground electrode planes are aligned with the planes of the center electrode.

11. The invention in accordance with claim 9 wherein the threads formed on the ground electrode define the outer perimeter of a plane being interrupted by spaces and the threads of said ground electrode planes are misaligned with the planes of center electrode.

12. The invention in accordance with claim 11 wherein the misalignment is greater than one degree.

13. A method of manufacturing a spark plug including the acts of:

(a) forming a spark plug housing with a first end and a second end;

(b) forming within the spark plug housing a center electrode having a generally cylindrical sidewall that is exposed proximate the first end of the spark housing;

(c) forming at the first end of the spark plug housing a ground electrode having a generally annular configuration including an annular sidewall proximate to and opposing the exposed center electrode;

(d) forming a plurality of circumferentially spaced breaks on the annular sidewall of the ground electrode, the circumferentially spaced breaks forming a plurality of sharp edges for sparks to propagate between the center electrode and the ground electrode;

(e) forming a plurality of longitudinally disposed flutes formed in the annular sidewall.

14. The method of claim 13 wherein the act of forming the plurality of circumferentially spaced breaks comprises longitudinally disposed "T"-shaped projections formed in the annular sidewall.

15. The method of claim 13 wherein the act of forming the plurality of circumferentially spaced breaks comprise longitudinally disposed saw tooth-shaped projections formed in the annular sidewall.

16. A method of manufacturing a spark plug comprising the acts of:

(a) forming a spark plug housing with a first end and a second end;

(b) forming within the spark plug housing a center electrode having a cylindrical sidewall that is at least partially exposed proximate the first end of the spark plug housing;

(c) forming at the first end of the spark plug housing a ground electrode having a generally annular sidewall proximate the center electrode; and (d) forming on the sidewall of one of the electrodes a plurality of screw threads for sparks to propagate between the center electrode to the ground electrode;

(e) forming a plurality of threads in the exposed surface of the center electrode.

17. A method of manufacturing a spark plug comprising the acts of:

(a) forming a spark plug housing with a first end and a second end;

(b) forming within the spark plug housing a center electrode having a cylindrical sidewall that is at least partially exposed proximate the first end of the spark plug housing;

(c) forming at the first end of the spark plug housing a ground electrode having a generally annular sidewall proximate the center electrode; and (d) forming on the sidewall of one of the electrodes a plurality of screw threads for sparks to propagate between the center electrode to the ground electrode;

(e) forming threads in the exposed surface of the ground electrode.

18. A method of manufacturing a spark plug comprising the acts of:

(a) forming a spark plug housing with a first end and a second end;

(b) forming within the spark plug housing a center electrode having a cylindrical sidewall that is at least partially exposed proximate the first end of the spark plug housing;

(c) forming at the first end of the spark plug housing a ground electrode having a generally annular sidewall proximate the center electrode; and (d) forming on the sidewall of one of the electrodes a plurality of screw threads for sparks to propagate between the center electrode to the ground electrode;

(e) forming threads in the exposed surface of both electrodes.

19. A method of manufacturing a spark plug comprising the acts of:

(a) forming a spark plug housing with a first end and a second end;

(b) forming within the spark plug housing a center electrode having a cylindrical sidewall that is at least partially exposed proximate the first end of the spark plug housing;

(c) forming at the first end of the spark plug housing a ground electrode having a generally annular sidewall proximate the center electrode; and (d) forming on the sidewall of one of the electrodes a plurality of screw threads for sparks to propagate between the center electrode to the ground electrode.

* * * * *